US005955165A

United States Patent [19]

Zamora et al.

[11] Patent Number: 5,955,165

[45] Date of Patent: Sep. 21, 1999

[54] APPARATUS FOR HANDLING VISCOUS MATERIALS, COMPOSITION FOR MAKING SUCH APPARATUS, METHOD OF MAKING SUCH APPARATUS

[75] Inventors: Pauline C. Zamora, Mill Valley, Calif.; Robert J. Kissner, Cincinnati, Ohio

[73] Assignee: The Proctor & Gamble Company, Cincinnati, Ohio

[21] Appl. No.: 08/837,792

[22] Filed: Apr. 22, 1997

[51] Int. Cl.[6] ..... B29D 22/00; C08K 5/00; C08K 5/09

[52] U.S. Cl. ..... 428/36.9; 428/36.91; 428/36.92; 428/424.2; 428/424.6; 428/516; 524/394; 524/392; 524/583

[58] Field of Search ..... 428/36.9, 36.91, 428/36.92, 424.2, 424.6, 516; 524/394, 392, 399, 583

[56] References Cited

U.S. PATENT DOCUMENTS

| | | | |
|---|---|---|---|
| 4,921,737 | 5/1990 | Akao | 428/36.92 |
| 5,560,544 | 10/1996 | Merritt et al. | 239/104 |
| 5,708,085 | 1/1998 | Hauenstein et al. | 524/269 |

FOREIGN PATENT DOCUMENTS

| | | |
|---|---|---|
| 02008047 | 11/1990 | Japan . |
| 93077510 | 10/1993 | Japan . |

OTHER PUBLICATIONS

Derwent WPIDS, Copyright 1998, 96–018445/02.
Derwent WPI Acc. #96–018445/02.
Nippon Nohyaku Co. Ltd. Publ #08113244 May 7, 1996.
May 7, 1996 Summary of "Resin Bottle with Non–Stick Liner Coating"Pub: 08113244.

*Primary Examiner*—James J. Seidleck
*Assistant Examiner*—Olga Asinovsky
*Attorney, Agent, or Firm*—J. M. Mark Gilbreth; Robert W. Strozier; Gilbreth & Strozier, P.C.

[57] ABSTRACT

Containers or other apparatus for viscous materials which allow for enhanced drainage or evacuation of the viscous material with a reduction in the amount of residual material that will remain in the container after evacuation. Compositions for making such containers include hydrophobic or poorly hydrophilic polymers and a polar additive. In the method of making such containers, the composition is made moldable and formed into the shape of the container and then cooled.

23 Claims, 1 Drawing Sheet

APPARATUS FOR HANDLING VISCOUS MATERIALS, COMPOSITION FOR MAKING SUCH APPARATUS, METHOD OF MAKING SUCH APPARATUS

BACKGROUND OF THE INVENTION

1. Field of the Invention

The present invention relates to an apparatus for handling viscous materials, to methods of making such apparatus, to compositions useful for making such apparatus, and to methods of making such compositions. In another aspect, the present invention relates to plastic containers having inside surface properties that result in enhanced product drainage from the container and the reduction of product residual levels, to methods of making such containers, and to plastic compositions useful in making such containers.

2. Description of the Related Art

Many liquid consumer products are provided in jars, bottles, tubes, or other containers, from which they are dispensed. Very commonly, the consumer pours, pumps, sprays, squeezes, or shakes the product out of the container. As most consumers have encountered, certain viscous products have a tendency to stick to or hang-up on the inside surface of the container, and there is always a residual amount of the product which cannot be evacuated from the container by simply pouring, pumping, squeezing, or shaking. With certain container geometries which do not permit suitable access to the inside of the container, this residual amount is inevitably discarded with the used container.

Polyethylene has long been a favored material for use in making containers for a wide range of consumer products. It is easily and economically formed into a multitude of geometric shapes to fulfill any engineering or marketing requirements. Its physical properties provide suitable strength and toughness to withstand shipping, handling, storage, and the occasional drop, and yet still allow for squeezability by consumers. Finally, the cost of the material itself is not an undue economic burden, which is important for a disposable container.

Common container materials (e.g., polyethylene) suffer greatly from the problem of product residue. Specifically, high product residual levels can be a problem in polyethylene containers, especially when the products contained are viscous materials, e.g., oil-in-water emulsions, water-in-oil emulsions, polymeric gels, foams, surfactant mixtures, dispersions, colloidal dispersions, suspensions, polymer solutions, polymer melts, and food products such as condiments, sauces, pastes, syrup and the like.

Typically, such viscous materials can be attracted to the interior surface of HDPE containers, with this attraction leading to a residual layer of product remaining on the interior container walls. In some instances, this residual amount may be on the order of 10 to 25 or more weight percent.

A similar type of product residual problem can occur in any application in which viscous materials are contacting nozzles, tubing, hoses, sprayers, funnels, piping, trays, troughs, liners, ductwork, channels, tanks, utensils, scoops, cups, pots, pitchers, brushes, pistons, impellers, stirrers, films, laminates, pouches, bags and sachets, pumps, tubes, pipets and jars and the like.

Prior art solutions to these type of product residual problems have suggested additives, blends or coatings to render the surface repellant of the viscous material.

For example, U.S. Pat. No. 5,560,544, issued October 1, to Merritt et al., discloses the problem of product accumulation on the walls or passage or the sides of an atomizer nozzle orifice. As a solution, Merritt et al. disclose a reduced wettability composition for the nozzle including a base component and a wettability-reducing component for reducing the wettability of the base material with the fluid product. Merritt et al. teaches that the "reduced wettability attribute" ensures that the product will tend to "bead up" on and be repelled by the surfaces of the nozzle rather than wetting or coating the surfaces.

Derwent WPI Acc No.: 96-018445/02 discloses a releasing compound for use in the packaging of sticky or viscous products, where the inner layer of packaging is prepared by compounding polyolefins containing reactive groups (alkylozysilane etc.) with silicone oil, which also contains reactive groups (silanol etc.).

Japanese patents JP02008047 and JP93077510 disclose a plastic container useful for viscous foodstuffs containing fat and oil having a viscosity above 30,000 cp. The portion of the container contacting with the foods stuffs is made of a hydrophobic plastic blended with 400–50,000 ppm of a blended-resin.

Nippon Nohyaku Co., Ltd., Publication no. 08113244 and application date May 07, 1996, discloses a bottle composed primarily of synthetic resin coated on the interior face with a silicone oil to prevent viscous or adhesive liquid from sticking to its inner surface.

However, in spite of the prior art teachings, there is a need in the art for improved product containers, for compositions for making such containers, and for methods of making such containers.

There is another need in the art for product containers having reduced product residue, for compositions for making such containers, and for methods of making such containers.

There is even another need in the art for improved product containers having inside surface properties that result in enhanced product drainage from the container and the reduction of product residual levels, for compositions for making such containers, and for methods of making such containers.

There is still another need in the art for nozzles, tubing, hoses, sprayers, funnels, piping, trays, troughs, liners, ductwork, channels, tanks, utensils, scoops, cups, pots, pitchers, brushes, pistons, impellers, stirrers, films, laminates, pouches, bags, and sachets, pumps, tubes, pipets and jars and the like, having reduced product residue, for compositions for making such, and for methods of making such.

These and other needs in the art will become apparent to those of skill in the art upon review of this specification, including its drawings and claims.

SUMMARY OF THE INVENTION

It is an object of the present invention to provide for improved product containers, for compositions for making such containers, and for methods of making such containers.

It is another object of the present invention to provide for product containers having reduced product residue, for compositions for making such containers, and for methods of making such containers.

It is even another object of the present invention to provide for improved product containers having inside surface properties that result in enhanced product drainage from the container and the reduction of product residual levels, for compositions for making such containers, and for methods of making such containers.

It is still another object of the present invention to provide for nozzles, tubing, hoses, sprayers, funnels, piping, trays, troughs, liners, ductwork, channels, tanks, utensils, scoops, cups, pots, pitchers, brushes, pistons, impellers, stirrers, films, laminates, pouches, bags and sachets, pumps, tubes, pipets and jars and the like, having reduced product residue, for compositions for making such, and for methods of making such.

These and other objects of the present invention will become apparent to those of skill in the art upon review of this specification, including its drawings and claims.

According to one embodiment of the present invention there is provided, a container for containing a viscous product, and providing enhanced product drainage from the container. The container includes a layer defining an enclosure for the viscous product, with the layer having a surface which contacts the product and provides for enhanced product drainage from the surface. Furthermore, the surface comprises a polymer and a hydrophilic additive, with the additive present in the range of about 0.5 to about 20 weight percent, based on the weight of the polymer.

According to another embodiment of the present invention there is provided a method for forming a container for containing a viscous product, said container providing enhanced product drainage from the container. The method generally includes forming a mixture of polymer and hydrophilic additive, wherein the additive is present in the mixture in the range of about 0.5 to about 20 weight percent, based on the weight of the polymer. The method then includes forming the mixture into a layer defining an enclosure for the viscous product, the layer having a surface which contacts the product and provides for enhanced product drainage from the surface.

According to even another embodiment of the present invention there is provided an apparatus for handling a viscous material, and providing enhanced drainage from the apparatus. The apparatus comprises a surface for contacting the product and which provides for enhanced product drainage from the surface. The surface comprises a polymer and a hydrophilic additive, with the hydrophilic additive present in the range of about 0.5 to about 20 weight percent, based on the weight of the polymer.

DETAILED DESCRIPTION OF THE INVENTION

Figure 1:
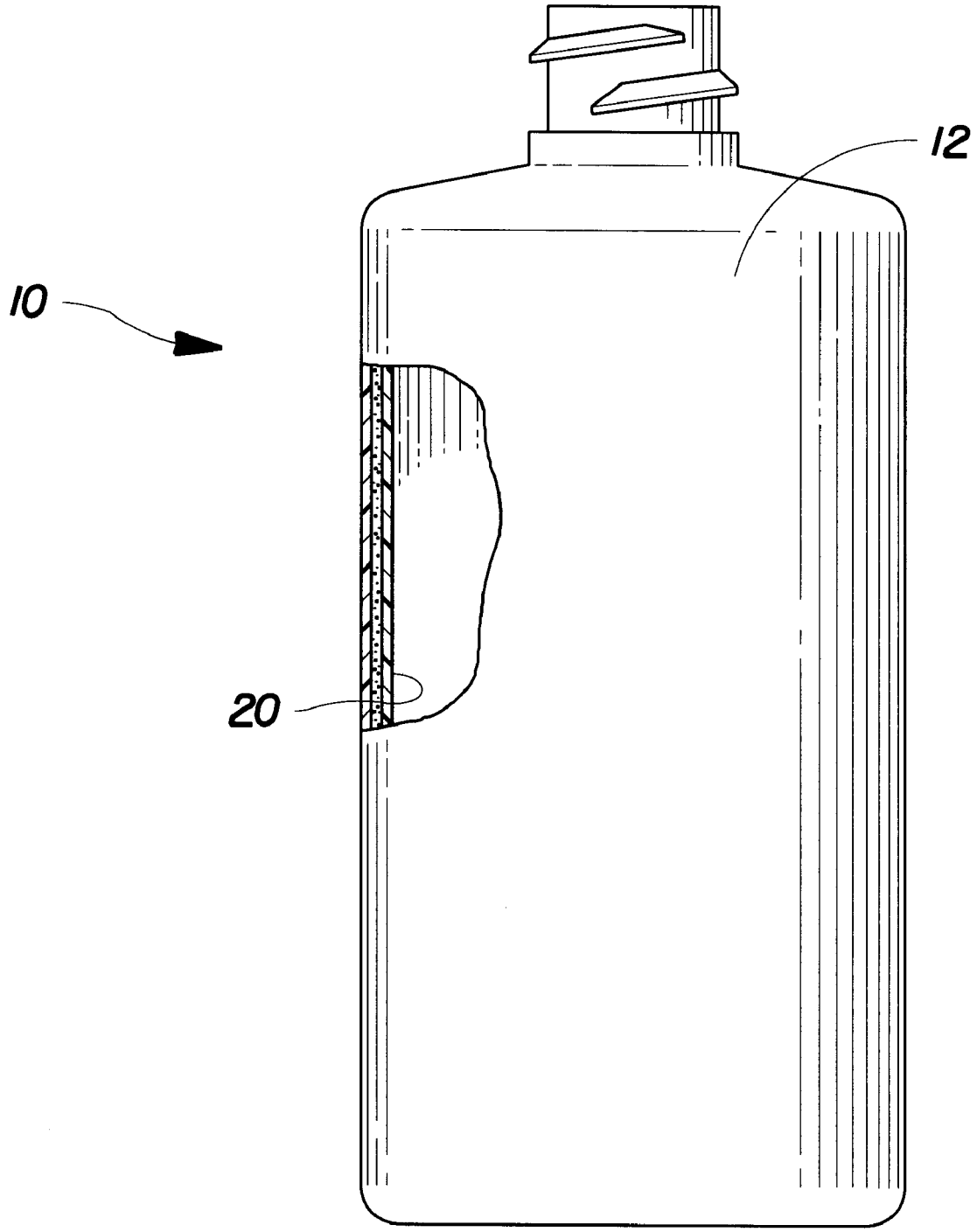
FIG. 1 is an illustration of one embodiment of the present invention showing bottle 10 having bottle wall 12, with inner surface 20 of wall 12 comprising polymer and a hydrophilic additive.

Referring first to FIG. 1 there is shown an illustration of one embodiment of the present invention showing bottle 10 having bottle wall 12, with inner surface 20 of wall 12 comprising polymer and a hydrophilic additive.

The composition useful in the present invention for making containers and other objects with viscous products (e.g., liquids, fluids, or the like) contacting surfaces with reduced product residual properties generally comprises a polymer and a polar additive.

The present invention is believed to find utility with a broad range of polymers including thermosets, thermoplastics, elastomers and castables.

It is noted that for any given geometry and liquid product, some polymers will exhibit good product residual amounts, whereas other polymers exhibit less than good product residual amounts. While the present invention is believed to be most helpful in improving the product residual amounts for those products exhibiting less than good product residual amounts, it should also find some applicability with those polymers which already exhibit good product residual amounts.

In general, while the present invention is believed to be applicable to any polymer, the preferred polymers for which the present invention is believed to be most helpful are those polymers considered hydrophobic or poorly hydrophilic. These preferred polymers which are considered hydrophobic or poorly hydrophilic are generally non-polar or poorly polar.

Non-limiting examples of the preferred polymers which are hydrophobic or poorly hydrophilic include polyolefins, polyvinyl chlorides (PVC), acrylonitrile-butadiene-styrenes (ABS) or polystyrenes.

In the practice of the present invention, polyolefins include homopolymers of olefins, copolymers of one or more olefins, copolymers of one or more olefins and one or more non-olefin monomers. The preferred polyolefins include those polymerized from ethylene or propylene. The more preferred polyolefin is an ethylene based polymer or copolymer. The even more preferred polyolefin is a high density polyethylene.

Very surprisingly in the practice of the present invention, the residual amount for viscous products is reduced if the hydrophobic polymer is made more hydrophilic. This is counter-intuitive, as one of skilled in the art would believe that a more hydrophilic polymer would actually attract and retain more of a water-containing viscous material. This is also against the teaching of earlier discussed U.S. Pat. No. 5,560,544, which teaches the use of a reduced wettability composition to repel and thus reduce the amount product accumulation on a polymer surface.

Hydrophilic additives suitable for use in the present invention, include any which when added to the polymer of the present invention will reduce the residual amount of consumable product which will remain on the polymer surface. In the present invention, the function of the hydrophilic additive is to render the polymer surface more hydrophilic.

It is noted that a given hydrophilic additive may not be suitable for use with all of the above listed polymers for a particular application with a particular viscous material. However, it is also noted that it is simple to incorporate the additive into the polymer and test it with the viscous material, for example as shown in the examples.

In general, hydrophilic additives suitable for use with the preferred hydrophobic or poorly hydrophilic polymers, will comprise a hydrophilic portion and a hydrophobic portion. The hydrophobic portion serves to urge compatibility of the additive with the preferred hydrophobic or poorly hydrophilic polymer, and the hydrophilic portion serves to provide hydrophilic characteristics to the polymer surface to urge compatibility with the preferred viscous material.

In many instances, the hydrophilic portion will be separated from the hydrophobic portion by a sufficiently large hydrocarbon or substituted hydrocarbon portion.

A non-limiting example of a suitable group of hydrophilic additives includes derivatives of naturally occurring or synthetic fatty acids, esters, alkoxylated amines, silicones, especially silicones having a hydrophilic head group or a polar head group and surfacants.

The suitable fatty acid derivatives useful in the practice of the present invention include those having a carbon chain length of 8 or more. The carbon length is generally selected to provide proper compatibility with polymer.

Generally, the fatty acid derivatives utilized in the present invention have a carbon chain length in the range of about 8 to about 30 carbon atoms, preferably in the range of about 14 to about 22 carbon atoms, and most preferably in the range of about 18 to about 22 carbon atoms.

The fatty acid derivative suitable for use in the present invention may be derived from naturally occurring fats and oils including the following animal oils and fats: butter, lard, tallow, grease, herring, menhaden, pilchard and sardine; and including the following vegetable oils and fats: castor, coconut, corn, cottonseed, jojoba, linseed, liticica, olive, palm, palm kernel, peanut, rapeseed, safflower, soya, sunflower, tall and tung.

Selection of which naturally occurring fatty acid to utilize will generally depend upon compatibility with the polymer.

Specific nonlimiting examples of fatty acids suitable for use in making the fatty acid derivatives of the present invention include octanoic, decanoic, dodecanoic, 9-dodecenoic(cis), tetradecanoic, 9-octadecenoic-12-hydroxy(cis), 9,12,15-octadecatrienoic(cis,cis,cis), 9,11,13-octadecatrienoic (cis,trans,trans), 9,11,13-octadecatrienoic-4-oxo(cis,trans,trans), octadecatetrenoic, eicosanoic, 11-eicosenoic(cis), eicosadeinoic, eicosatrienoic, 5,8,11,14-eicosatetraenoic, eicosapentaenoic, docosanoic, 13-docosenoic(cis) docosatetraenoic, 4,8,12,15,19 docosapentaenoic, docosahexaenoic, tetracosenoic, 4,8,12, 15,18,21-tetracosahexaenoic.

Suitable fatty acid derivatives include alkali, alkaline earth, or transition metal substituted fatty acids; oxidized fatty acids; amides of fatty acids; amines of fatty acids; salts of fatty acids; esters of fatty acids; sulfated fatty acids; sulfonated fatty acids; alkoxylated fatty acids; phosphatized fatty acids; and mixtures thereof. Preferably, the fatty acid derivatives utilized in the present invention are alkoxylated fatty acids, fatty amines, and fatty esters.

Non-limiting examples of commercially available hydrophilic additives suitable for use in the present invention include an ethoxylated tallow alkyl amine available under the tradename Kemanime AS-974-1 available from the Witco Corporation, and a fatty ester available under the tradename Markstat AS-7 available from the Witco Corporation.

In the practice of the present invention, any relative amounts of plastic and polar additive may be utilized that will provide the desired hydrophilic property to the surface of the polymer. In general, the hydrophilic additive is provided to the polymer in an effective amount to reduce residual viscous product remaining on a contact surface. The effective amount polar additive will be selected upon consideration of the polymer, the product to be used therewith, economic factors, and engineering considerations.

Based on the total weight of plastic and polar additive, the composition will generally comprise in the range of about 0.5 to about 20 weight percent hydrophilic additive, will preferably comprise in the range of about 2 to about 20 weight percent hydrophilic additive, will more preferably comprise in the range of about 3 to about 15 weight percent hydrophilic additive, and will even more preferably comprise in the range of about 3 to about 10 weight percent hydrophilic additive.

The composition of the present invention may be formed by blending the polar additive with the plastic in molten form, or the polar additive may be compounded with the plastic.

In the practice of the present invention, it is also envisioned that the hydrophilic additive may comprise a layer on the surface of the polymer (e.g., coatings), rather than being incorporated therein.

The present invention will find utility with a wide range of viscous products. Non-limiting examples of viscous products to which the present invention is applicable include oil-in-water emulsions, water-in-oil emulsions, polymeric gels, foams, surfactant mixtures, dispersions, colloidal dispersions, suspensions, polymer solutions, polymer melts, detergents, laundry and cleaning products, adhesives, paints, chemicals, food products such as condiments, mayonnaise, ketchup, mustard, sauces, pastes, syrup and the like, and health and beauty products such as cosmetics, lotions, creams, gels, sprays, mousses, shampoos and conditioners and the like.

The compositions of the present invention may optionally also contain conventional ingredients as are known to those of skill in the art. Non-limiting examples of such conventional ingredients include antiblocking agents, antistatic agents, antioxidants, blowing agents, crystallization aids, colorants, dyes, flame retardants, fillers, impact modifiers, mold release agents, oils, other polymers, pigments, processing agents, reinforcing agents, stabilizers, UV resistance agents, antifogging agents, wetting agents and the like.

Non-limiting examples of reinforcing agents include inorganic or organic products of high molecular weight, including glass fiber, asbestos, boron fibers, carbon and graphite fibers, whiskers, quartz and silica fibers, and synthetic organic fibers.

When such conventional ingredients are utilized, they will generally be present in a range from about 0.01 to about 50 weight percent of the composition, preferably in a range from about 1 to about 25 weight percent of the composition.

The compositions of the present invention may be shaped into final products, which may be rigid or flexible, by any of the known plastic forming techniques. Non-limiting examples of suitable techniques include, blowing, blow molding, injection molding, extruding, pultruding, thermoforming, casting, vacuum molding, stamping, forging, melt or solid phase forming, rotary molding, and the like. The conditions for the various plastic forming techniques, such as pressure, residence time, type of machinery, and the like, may be determined by one skilled in the art of forming plastics.

When forming the containers or other objects of the present invention, the entire container or object may be made from the composition of the present invention, or only those surfaces in contact with the viscous product may be made from the composition of the present invention. For example, a shampoo bottle may be blow molded from a composition of polyethylene and polar additive. Alternatively, a polyethylene shampoo bottle may be provided with a polyethylene/polar additive liner, surface, inner layer or layer which will be in contact with the shampoo.

Where only the portion of the apparatus in contact with the viscous material will be made from the composition of the present invention, any suitable fabrication technique may be utilized to create that portion and assemble such to the apparatus. For example, where the inside of a tank, container or the like is to be made from the composition of the present invention, the tank, container and the like may be coated with the composition or treated with a composition containing a hydrophilic additive, where this composition may not necessarily include a polymer.

EXAMPLES

The following examples are provided merely to illustrate some embodiments of the present invention and do not limit the scope of the claims Example 1

Drainage Test on Sample Strips Inclined 30° and Then 90°

This example is a "drainage" test utilizing sample strips of high density polyethylene ("HDPE") modified with various hydrophilic additives, inclined at 30° for one hour, and then subsequently at 90° one hour.

Compounded formulations of HDPE with various hydrophilic additives were injection molded into material strips approximately 0.5×5 inches. The strips were allowed to "age" for one month at 145° F. to accelerate migration of the additive to the surface. A sample of Olay Moisturizing Body Wash ("OMBW"), an oil-in-water emulsion, was placed approximately 3.5 inches from the edge of a material strip. The material strip was subsequently placed on a 30° incline platform where product was allowed to drain from the strip for one hour. The material strip was then inclined further to 90° and allowed to drain for one more hour. The drainage tests were performed five times for each sample, with the resulting averages listed in Table 1 below.

TABLE 1

| Average Residual Amount Remaining On Incline Sample After One Hour At 30° Followed By One Hour At 90° | | |
|---|---|---|
| Additive | Wt % Concentration of Additive in HDPE | Average % Residual Amount of Olay Remaining |
| None (Control) | 0.0 | 10.09 |
| Atmos 150 | 2.0 | 8.80 |
| Markstat AS-7 | 1.0 | 6.46 |
| Morphathane #4000 | 4 | 7.42 |
| Unithox 720 Ethoxylate | 5 | 9.83 |
| Hostastat FA 38 | 1 | 7.11 |
| Kemamine AS-974-1 | 0.8 | 4.79 |

Example 2

Evacuation/Dispensing Test on Elliptical Bottle

This example is an evacuation/dispensing test utilizing elliptical/oval bottles of high density polyethylene ("HDPE") modified with various hydrophilic additives.

Compounded formulations of HDPE with various hydrophilic additives were blow molded into 14 oz. elliptical bottles. Some of the bottles were aged at 145° F. to accelerate additive migration to the surface. Evacuation/dispensing tests with Olay Moisturizing Body Wash ("OMBW"), were performed with the non-incubated (unaged) bottles and with those after aging for one week.

Dispensing was conducted as follows.

1. Record weight of each assembled package.
2. Fill each sample with the correct fill weight and record weight.
3. Allow package to sit in "inverted" position for 24 hours at ambient temperature.
4. Dispense package to approximately ⅓ full and allow package to sit in designated position for at least one hour.
5. Repeatedly squeeze package until product begins to sputter.
6. "Tap" package five times against hard surface and repeat process until package does not dispense the minimal dosage of 5 grams.
7. Allow package to sit in designated position for 24 hours and repeat step 6.
8. Record empty weight and calculate % residual.

The additives utilized were Kemamine AS-974-1, an ethoxylated tallow alkyl amine, and Markstat AS-7, a fatty ester, both incorporated at 10 weight percent, based on the weight of HDPE. The results of the evacuation/dispensing tests are listed in Table 2.

TABLE 2

| | Evacuation/Dispensing Tests For Elliptical Bottle | | | |
|---|---|---|---|---|
| Additive | Water Contact Angle (°) (unaged) | OMBW Evacuation Residual (%) (unaged) | Water Contact Angle (°) (aged) | OMBW Evacuation Residual (%) (aged) |
| None (high gloss HPDE) | 92 | 7.5 | 93 | 7.8 |
| Kemamine AS-974-1 | 50 | 6.1 | 67 | 3.7 |
| Markstat AS-7 | 45 | 4.2 | 52 | 2.7 |

While the illustrative embodiments of the invention have been described with particularity, it will be understood that various other modifications will be apparent to and can be readily made by those skilled in the art without departing from the spirit and scope of the invention. Accordingly, it is not intended that the scope of the claims appended hereto be limited to the examples and descriptions set forth herein but rather that the claims be construed as encompassing all the features of patentable novelty which reside in the present invention, including all features which would be treated as equivalents thereof by those skilled in the art to which this invention pertains.

We claim:

1. A container containing a viscous product, the container comprising a surface which contacts the product and provides for enhanced product drainage from the surface, wherein the surface comprises a polymer and an effective amount of a hydrophilic additive to enhance product drainage from the surface, wherein the hydrophilic additive comprises at least one selected from the group consisting of alkali, alkaline earth, or transition metal substituted fatty acids, oxidized fatty acids, salts of fatty acids, esters of fatty acids, sulfated fatty acids, sulfonated fatty acids, alkoxylated fatty acids, and phosphatized fatty acids, wherein the additive is present in the range of about 3 to about 15 weight percent, based on the weight of the polymer and additive and wherein the viscous product includes at least one selected from the group consisting of oil-in-water emulsions, water-in-oil emulsions, polymeric gels, foams, surfactant mixtures, dispersions, colloidal dispersions, suspensions, polymer solutions, polymer melts, food products, health and beauty products, laundry products and cleaning products.

2. The container of claim 1 wherein the polymer comprises at least one selected from the group consisting of polyolefins, polyvinyl chlorides, acrylonitrile-butadiene-styrene copolymers and polystyrenes.

3. The container of claim 2, wherein the polyolefin is selected from the group consisting of homopolymers of olefins, copolymers of at least two olefins, and copolymers of at least one olefin and at least one non-olefin monomer.

4. The container of claim 3, wherein the polyolefin is selected from the group consisting of polyethylene and polypropylene.

5. The container of claim 4, wherein the polyolefin is selected from the group consisting of low, medium, linear low, high molecular weight and high density polyethylene.

6. The container of claim 1, wherein the hydrophilic additive comprises at least one selected from the group consisting of alkoxylated amines, esters, fatty acids, fatty amines, and fatty esters.

7. The container of claim 1, wherein the hydrophilic additive is selected from the group consisting of ethoxylated tallow alkyl amine and fatty ester.

8. A method for forming a container containing a viscous product, said container providing enhanced product drainage from the container, the method comprising:

(a) forming a mixture of polymer and an effective amount of a hydrophilic additive to enhance product drainage, wherein the hydrophilic additive comprises at least one selected from the group consisting of alkali, alkaline earth, or transition metal substituted fatty acids, oxidized fatty acids, salts of fatty acids, esters of fatty acids, sulfated fatty acids, sulfonated fatty acids, alkoxylated fatty acids, and phosphatized fatty acids; and (b) forming the mixture into a container defining an enclosure for the viscous product, the container having a surface which contacts the product and provides for enhanced product drainage from the surface, wherein the mixture comprises in the range of 3 to about 15 weight percent additive; and (c) positioning a viscous product in the container, wherein the viscous product includes at least one selected from the group consisting of oil-in-water emulsions, water-in-oil emulsions, polymeric gels, foams, surfactant mixtures dispersions, colloidal dispersions, suspensions, polymer solutions, polymer melts, food products, health and beauty products, laundry products and cleaning products.

9. The method of claim 8, wherein the polymer comprises at least one selected from the group consisting of polyolefins, polyvinyl chlorides, acrylonitrile-butadiene-styrenes and polystyrenes.

10. The method of claim 9, wherein the polyolefin is selected from the group consisting of homopolymers of olefins, copolymers of at least two olefins, and copolymers of at least one olefin and at least one non-olefin monomer.

11. The method of claim 10, wherein the polyolefin is selected from the group consisting of polyethylene and polypropylene.

12. The method of claim 11, wherein the polyolefin is selected from the group consisting of low, medium, linear low, high molecular weight and high density polyethylene.

13. The method of claim 12, wherein the hydrophilic additive comprises at least one selected from the group consisting of alkoxylated amines, esters, fatty acids, fatty amines, and fatty esters.

14. The method of claim 13, wherein the hydrophilic additive is selected from the group consisting of ethoxylated tallow alkyl amine and fatty ester.

15. An apparatus for handling a viscous material, and providing enhanced drainage from a surface of the apparatus contacting the product, which surface provides for enhanced product drainage from the surface, wherein the surface comprises a polymer and an effective amount of a hydrophilic additive wherein the hydrophilic additive comprises at least one selected from the group consisting of alkali alkaline earth, or transition metal substituted fatty acids, oxidized fatty acids, salts of fatty acids, esters of fatty acids, sulfated fatty acids, sulfonated fatty acids, alkoxylated fatty acids, and phosphatized fatty acids, and wherein the additive is present in the range of about 3 to about 10 weight percent, based on the weight of the polymer and the additive to enhance product drainage from the surface.

16. A container for containing a viscous product, and providing enhanced product drainage from the container, the container comprising a surface which contacts the product and provides for enhanced product drainage from the surface, wherein the surface comprises a polymer and an effective amount of a hydrophilic additive to enhance product drainage from the surface, wherein the hydrophilic additive comprises at least one selected from the group consisting of alkali, alkaline earth, or transition metal substituted fatty acids, oxidized fatty acids, salts of fatty acids, esters of fatty acids, sulfated fatty acids, sulfonated fatty acids, alkoxylated fatty acids, and phosphatized fatty acids; and wherein the additive is present in the range of about 3 to about 15 weight percent, based on the weight of the polymer.

17. The container of claim 16, further including a viscous product contained therein, wherein the viscous product includes at least one selected from the group consisting of oil-in-water emulsions, water-in-oil emulsions, polymeric gels, foams, surfactant mixtures, dispersions, colloidal dispersions, suspensions, polymer solutions, polymer melts, food products, health and beauty products, laundry products and cleaning products.

18. The container of claim 16 wherein the polymer comprises at least one selected from the group consisting of polyolefins, polyvinyl chlorides, acrylonitrile-butadiene-styrene copolymers and polystyrenes.

19. The container of claim 18, wherein the polyolefin is selected from the group consisting of homopolymers of olefins, copolymers of at least two olefins, and copolymers of at least one olefin and at least one non-olefin monomer.

20. The container of claim 18, wherein the polyolefin is selected from the group consisting of polyethylene and polypropylene.

21. The container of claim 18, wherein the polyolefin is selected from the group consisting of low, medium, linear low, high molecular weight and high density polyethylene.

22. The container of claim 16, wherein the hydrophilic additive comprises at least one selected from the group consisting of alkoxylated amines, esters, fatty acids, fatty amines, and fatty esters.

23. The container of claim 16, wherein the hydrophilic additive is selected from the group consisting of ethoxylated tallow alkyl amine and fatty ester.

* * * * *